US005809956A

United States Patent [19]

Regueiro

[11] Patent Number: 5,809,956

[45] Date of Patent: Sep. 22, 1998

[54] MINI ROLLER ARRANGEMENT FOR VALVE TRAIN MECHANISM

[75] Inventor: Jose F. Regueiro, Rochester Hills, Mich.

[73] Assignee: Chrysler Corporation, Auburn Hills, Mich.

[21] Appl. No.: 992,076

[22] Filed: Dec. 17, 1997

[51] Int. Cl.[6] ..... F01L 1/16; F01L 1/18

[52] U.S. Cl. ..... 123/90.27; 123/90.42; 123/90.5

[58] Field of Search ..... 123/90.27, 90.39, 123/90.42, 90.44, 90.46, 90.48, 90.5; 74/519, 559, 569

[56] References Cited

U.S. PATENT DOCUMENTS 4,335,685 6/1982 Clouse ..... 123/90.5
5,398,648 3/1995 Spath et al. ..... 123/90.5
5,520,144 5/1996 Philo et al. ..... 123/90.5
5,566,652 10/1996 Deppe ..... 123/90.42
5,638,783 6/1997 Regueiro ..... 123/90.22
5,645,023 7/1997 Regueiro ..... 123/90.27
5,673,657 10/1997 Cecur ..... 123/90.5
5,676,098 10/1997 Cecur ..... 123/90.5

*Primary Examiner*—Weilun Lo
*Attorney, Agent, or Firm*—Kenneth H. Maclean

[57] ABSTRACT

A valve train mechanism for an internal combustion engine that has one of its members formed with at least two partial cylindrical cavities supporting at least a pair of shaftless rollers that are adapted to be in successive contact with a cam-lobe of a camshaft and serve to convert the rotary motion of the camshaft to linear movement of a valve.

15 Claims, 4 Drawing Sheets

152
154
156
150
184
188
182
186
158
160
174
164
162
178
186
172
166
180
168
176
178
170
140
144
146
148
142

MINI ROLLER ARRANGEMENT FOR VALVE TRAIN MECHANISM

FIELD OF THE INVENTION

This invention concerns internal combustion engines and, more particularly, relates to an engine valve train mechanism with intake valves and exhaust valves and having one of its members provided with a mini-roller arrangement which includes at least two shaftless rollers engaged by a cam-lobe shaft for actuating the intake and exhaust valves.

BACKGROUND OF THE INVENTION

My co-pending United States patent application Ser. No. 08/920,910, entitled "Roller Arrangement For Valve Train Mechanism", filed on Aug. 29, 1997 discloses a valve train mechanism that utilize a variety of valve actuators such as direct-acting bucket tappets, finger followers and rocker arms which are in contact with a camshaft. These mechanisms utilize a small-diameter roller to minimize the friction between two elements of the mechanism that are in contact with each other and in which relative motion is required to operate the valves. In each instance, the roller is a shaftless roller (i.e. not supported for rotation by a shaft) and is disposed in a half-bearing or trough so as to be supported for rotation on its outside diameter. More specifically, the above-mentioned application discloses various means of supporting the simple roller and maintaining it encapsulated within its half-bearing cavity.

One advantage in having a roller of the shaftless design is that there is a reduction in parts and a lessening of precise machining with the result that the cost of the mechanism is reduced. However, even with roller arrangements of this type, the mass, inertia and height of the mechanism can be critical especially when used with inverted-bucket tappets. Inasmuch as overhead valve trains have heretofore used roller tappets, the increase in mass or height has not been an important consideration. This is so because the roller increases the total mass of the mechanism by a very small amount relative to the ancillary parts of the mechanism such as the in-block mounted tappet, push-rod, rocker arm and the valve and spring elements. The height issue is also of small consequence because it is typically solved easily by extending the tappet guide upwards to accept the higher operating position of the tappet body while compensating for the height increase of the roller tappet by shortening the push-rod by the same amount. In addition, a guide mechanism is provided to prevent the whole roller tappet from rotating and losing its alignment with the camshaft. The reduced friction with a roller follower merits the changes.

In the case of a direct-acting overhead camshaft mechanism having an inverted-bucket tappet, using a roller tappet increases both the weight and height of the tappet. Even the small mass of a shaftless roller, such as described in my aforementioned patent application, can increase the percentage of the total mass to an undesirable level. In addition, the height of the valve train mechanism also increases, forcing a higher located camshaft that increases the height and weight of the engine. Today, this is not acceptable with most of the sophisticated high-speed engines that require a very low hoodline for aerodynamic reasons and also a low weight. This is the reason why roller tappets, easily tolerated on conventional overhead valve engines, are considered to be undesirable for direct-acting overhead camshaft engines.

Other valve train mechanisms using finger-followers or rocker arms combined with the shaftless rollers (described in my aforementioned patent application) so as to offer lower mass and bulk than the traditional shafted-roller mechanisms, could still use a further reduction in bulk and mass. In the case of valve-train mechanisms, the lowest-possible bulk and mass is always a design goal. This is true not only for cost reasons, but because mass and inertia are directly related to engine performance, fuel consumption and emissions. These other valve train mechanisms, therefore, could also be improved by further reducing their bulk and mass.

SUMMARY OF THE INVENTION

The present invention proposes an improved form of roller assembly designed to be used with direct-acting inverted bucket tappets, finger followers, and rocker arm actuators of a valve train mechanism for converting the rotary motion of a camshaft to linear movement of a valve. More specifically, the valve train mechanism according to the present invention is intended to provide the low friction levels of roller mechanisms as well as low bulk and mass so as to reduce the cost as well as the inertia and height of the valve train mechanism. This is accomplished by a valve train mechanism incorporating a valve actuator provided with two or more side-by-side shaftless mini-rollers. The mini-rollers are disposed in respective machined bearings that take the form of partially-cylindrical cavities, serving as concave bearing surfaces for the rollers, and, in the case of an inverted-bucket tappet or a finger follower, are located at the top of the structure. When the invention is employed with a rocker arm, the cavities are formed in the bottom of one end of the rocker arm structure.

Accordingly, an object of the present invention is to provide a new and improved valve train mechanism for an internal combustion engine having one of the members of the valve train mechanism provided with two or more shaftless mini-rollers which are contacted by a cam-lobe of a camshaft for transmitting linear movement to a valve.

Another object of the present invention is to provide a new and improved valve train mechanism for an internal combustion engine that has a valve actuator formed with partially-cylindrical cavities supporting at least two shaftless mini-rollers which are successively contacted by a cam-lobe of a camshaft and serve to convert the rotary motion of the camshaft to linear movement of a valve.

A still another object of the present invention is to provide a new and improved valve train mechanism for an internal combustion engine having an inverted-bucket tappet supported for reciprocal sliding movement by the cylinder head and in which the top side of the tappet is provided with two or more partially-cylindrical cavities supporting shaftless rollers which are successively contacted by the cam-lobe of a camshaft so as to convert the rotary motion of the camshaft to linear motion of a valve.

A further object of the present invention is to provide a new and improved valve train mechanism having an actuator in the form of a finger follower one end of which is supported by the cylinder head and the other end of which serves to actuate a valve with an intermediate portion of the finger follower being provided with two or more shaftless mini-rollers which are sequentially contacted by the cam-lobe of a camshaft that upon rotation provides a valve lifting force to the rollers so that the finger follower acts through the other end thereof to move the valve to the open position.

A still further object of the present invention is to provide a new and improved valve train mechanism having an actuator in the form of a rocker arm an intermediate portion of which is supported by the cylinder head for pivotal movement and having one end thereof engaging the upper end of a valve stem with the other end of the rocker arm being provided with partial cylindrical cavities in which at least two shaftless mini-rollers are located which are in sequential contact with a cam-lobe of a camshaft the rotation of which results in the rocker arm moving the valve to an open position.

BRIEF DESCRIPTION OF THE DRAWINGS

Other objects, advantages, and features of the present invention will become apparent from the following detailed description of the invention when considered in conjunction with the following drawings in which.

DETAILED DESCRIPTION OF THE DRAWINGS

Figure 1:
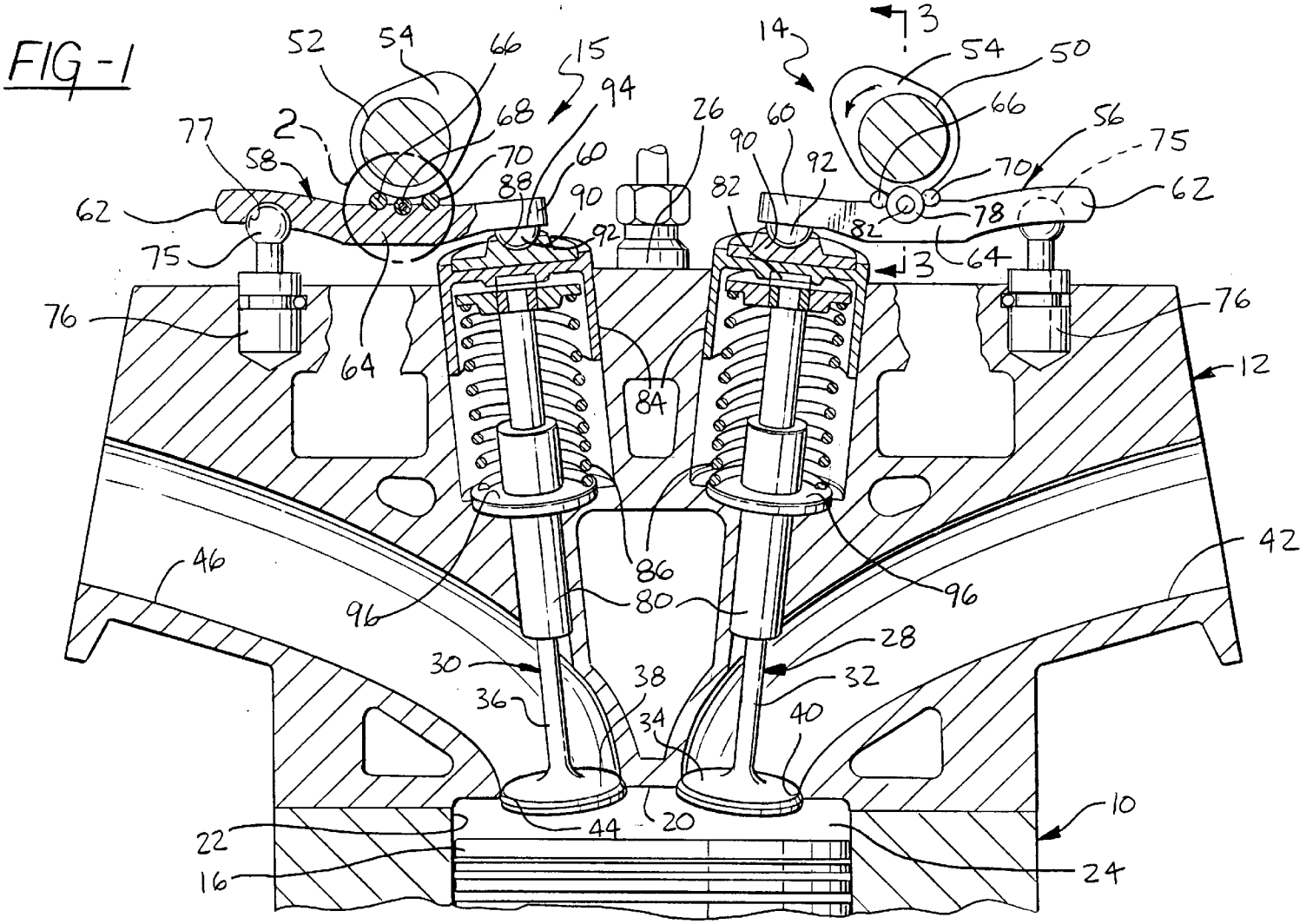
FIG. 1 is a view partially in section of a cylinder head incorporating a valve train mechanism including intake and exhaust valves and that employs an actuator and mini-roller assembly made in accordance with the present invention.

Referring now to the drawings and more particularly to FIG. 1 thereof, a single cylinder of a multi-cylinder engine is shown having an engine block 10 on which is secured by fasteners (not shown) a lower portion of a cylinder head 12 that incorporates a pair of identical valve train mechanisms 14 and 15.

Each of the cylinders of the engine house a piston 16 which moves axially along the longitudinal center axis of the associated cylinder and has the lower end thereof connected to the engine crankshaft (not shown) by a connecting rod (not shown). The cylinder head 12 is formed with a hemispherical surface 20 providing a recess which is aligned with the bore defining the associated cylinder 22 and together with the top of the piston 16 form a combustion chamber 24 which varies in volume during the operation of the engine. In this instance, a fuel injector 26 is threadably secured in the cylinder head 12 centrally of the hemispherical surface or recess 20 along the longitudinal axis of each cylinder 22. As will become apparent as the description of the present invention proceeds, the valve train mechanisms 14 and 15 according to the present invention can also be used with a spark ignition internal combustion engine in which a spark plug replaces the injector 26.

As seen in FIG. 1, the cylinder head 12 is provided with an intake valve 28 and an exhaust valve 30 located in side-by-side relationship. At this juncture, it will be understood that at each cylinder of the engine, an additional pair of similar valve train mechanisms (not shown) are positioned adjacent the valve train mechanisms 14 and 15 so as to provide four valves per cylinder. Accordingly, although not shown in FIG. 1 of the drawings, the intake valve 28 works with a similar intake valve for providing air into the cylinder 22 and an exhaust valve similar to exhaust valve 30 serves to exhaust the exhaust gases from the cylinder 22 during operation of the engine.

With further reference to FIG. 1, it will be noted that the intake valve 28 has a valve stem 32 the lower end of which is formed with a round valve head 34. Similarly, the exhaust valve 30 has a valve stem 36 the lower end of which is formed with a round valve head 38. As is conventional, each of the intake valve heads 34 is normally seated in a valve seat formed in the cylinder head that defines a round opening or port 40 of an intake passage 42 formed in the cylinder head 12 as seen in FIG. 1. Also, the exhaust valve head 38 is normally seated in a valve seat formed in the cylinder head 12 that defines a round opening or port 44 of an exhaust passage 46 formed in the cylinder head 12.

It will be noted that the valve stem 32 of the intake valve 28 and the valve stem 36 of the exhaust valve 30 are disposed radially about the cylinder head 12 such that the intersection of their longitudinal center axes occurs at a point located on the longitudinal center axis of the cylinder 22. In other words, the valve arrangement, as shown, is of the radial design as disclosed in my U.S. Pat. No. 5,570,665 issued on Nov. 5, 1996. As a result, the center of the valve head 34 of the intake valve 28 and the center of the valve head 38 of the exhaust valve 30 and the centers of the adjacent exhaust and intake valves (not shown) for the cylinder 22 are located on a common circle concentric with the periphery of the cylinder 22. Thus, the longitudinal centerline of each intake valve and each exhaust valve for cylinder 22 is canted at an equal angle to both the longitudinal and transversal planes of the engine. It will be understood that a similar mechanism could be used with a conventional valve train in which the valves are disposed with their stems in parallel to the main axis of the cylinder.

As seen in FIG. 1, a pair of laterally spaced overhead camshafts 50 and 52 are rotatably supported in the upper portion of the cylinder head 12 by a camshaft bearing saddle and camshaft cap (neither of which are shown) which are secured to the lower head portion of the cylinder head 12. Each of the camshafts 50 and 52 is supported for rotation about an axis that is substantially parallel to the rotational axis of the engine crankshaft and each camshaft 50 and 52 includes a plurality of cam-lobes, (one of which is only shown and identified by reference numeral 54) for actuating the valves 28 and 30 through actuator arms taking the form of finger followers 56 and 58.

Figure 3:
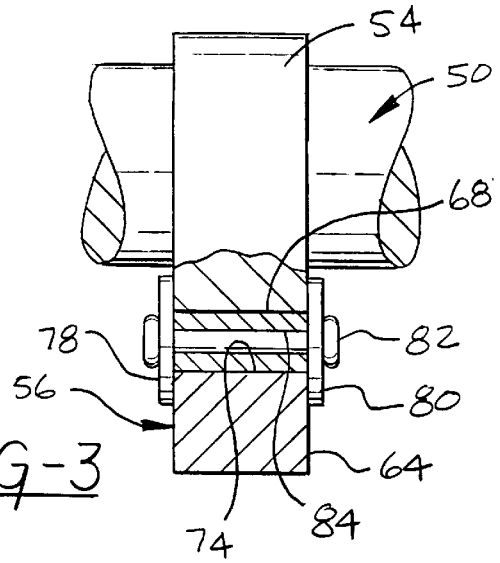
FIG. 3 is a sectional view taken on line 3—3 of FIG. 1.

In this regard, the finger followers 56 and 58 are identical in construction and each is formed as an elongated member having a head end 60 and a tail end 62 with a saddle portion 64 intermediate the two ends 60 and 62 that supports three equal diameter cylindrical mini-rollers 66, 68 and 70 respectively located in three machined cavities or cylindrical bearing surfaces 72, 74 and 76. As seen in FIGS. 1 and 3, the rollers 66–70 are retained in axial encapsulation with respect to the associated finger follower by two identical washers 78 and 80 held in place by a long rivet 82 extending through a elongated hole 84 centrally formed in the roller 68. The washers 78 and 80 also cover part of the opposed ends of each roller 66 and 70 so as to prevent axial movement thereof relative to their supporting bearing surfaces. In addition, as seen in FIG. 3, the washers 78 and 80 straddle the opposed sides of the associated cam-lobe so as to provide guidance to retain the associated finger follower aligned with the cam-lobe in the transversal plane of the engine.

As will become more apparent as the description of the invention proceeds, the rollers 66–70 are disposed in the saddle portion 64 of the finger follower for rotation therein. In the preferred form, the radius of the each bearing surface 72–76 will be slightly larger than the radius of the associated roller so as to allow a film of oil to be maintained between the bearing surface and the outer surface of the roller. The rollers 66–70 are shaftless and typically of substantially smaller diameter than their shafted counterparts as conventionally used at this time. Preferably, the rollers 66–70 can be of the type used in needle bearings and measure less than 6 mm in diameter.

During operation of the valve train mechanisms 14 and 15, lubricating oil splashing about the overhead cylinder head 12 of the engine will automatically cause the oil to find its way onto the bearing surfaces 72–76. As a result, the rollers 66–70 and the bearing surfaces 72–76, in combination, will operate in conformance with bearing-shaft hydrodynamic lubrication principles. In this case, each of the rollers 66–70 acts as the theoretical shaft against the associated bearing surface which has an active circumference that is slightly more than one-half its theoretical full-circumference. Thus, each of the rollers 66–70, in each instance, is able to rotate relative to the accommodating bearing surface while being restrained from axial movement by the washers 78 and 80 and prevented from being dislodged vertically from the saddle portion 64 of the finger follower by the encapsulation provided by the bearing surface.

Each of the finger followers 56 and 58 support each of the associated rollers 66–70 for rotation about an axis parallel to the rotational axis of the camshafts 50 and 52. In addition, each finger follower 56 and 58 is adapted to pivot about the ball portion 75 of a conventional hydraulic lash compensator 76 which is slidably disposed in the cylinder head 12. The ball portion 75 is received by a spherical recess 77 formed in the finger follower body at the tail end 62 of the associated finger follower.

Both the intake valve 28 and the exhaust valve 30 have their respective stems 32 and 36 extending upwardly from its valve head and passing through a guide sleeve 80 secured to the cylinder head 12. The flat upper end of each stem 32 and 36 abuts a flat anti-friction disc 82 which is disposed inside an associated inverted bucket tappet 84. Each inverted bucket tappet 84 is slidably mounted within the cylinder head 12 for linear reciprocal movement along an axis parallel or coaxial with the valve axis and against the bias of a compression spring 86, the upper end of which abuts a retainer secured to the upper end of the valve stem by a conventional two-piece lock. The top of each inverted bucket tappet is formed with a spherical recess 88 in which one part of a spherical joint is located.

In this regard, each spherical joint consists of a socket member 90 and a half-ball 92. The socket member 90 takes the form of a disc with the centrally located spherical recess 88 formed in the top surface of the socket member 90. The half-ball 92 has a spherical outer surface which is complementary in shape with the spherical recess 88 and is in contact therewith. The half-ball 92 also has a flat upper surface 94 which abuts the flat lower surface of the head end 60 of the associated finger follower.

It will be noted that the lower end of each compression spring 86 is seated on a washer 96 disposed in a conventional spot-faced recess formed in the lower head portion of the cylinder head 12. Thus, it should be apparent that the intake valve 28 and the exhaust valve 30 are normally maintained in the closed position shown by the associated compression spring 86. In addition, the fuel injector 26 is secured to the cylinder head 12 and is positioned centrally relative to the two intake valves and the two exhaust valves.

During operation of the valve train mechanism 14, the rotation of the camshaft 50 serves to actuate the finger follower 56 which, in turn, depresses the associated inverted bucket tappet 84. This occurs as the cam-lobe 54 of the camshaft 50 strokes the rollers 66–70 of the finger follower 56 causing the head end 60 thereof to pivot downwardly about the ball portion 70 under the guidance of the washers 78 and 80. As alluded to hereinbefore, the oil splashing about the overhead of the engine and under the valve cover falls on the rollers 66–70 and into the radial clearance between each of the rollers and its bearing surface. This action provides a constantly replenished source of lubricant for the rollers 66–70. As the rollers 66–70 rotate under the influence of the rotating cam-lobe 54, each roller builds a hydrodynamic oil film wedge between it and its bearing surface to prevent metal-to-metal contact between the two.

As the camshaft 50 rotates in the direction of the arrow as seen in FIG. 1, the cam-lobe 54 initially contacts the roller 66 and then successively contacts the rollers 68 and 70. This causes downward movement of the head end 60 of the finger follower 56 causing the intake valve 28 to be opened so as to allow communication between the intake passage 46 and the combustion chamber 24 via the port 40. As the inverted bucket tappet 84 moves downwardly under the urging of the finger follower 56, the socket member 90 experiences a compound motion. That is, due to the inclination of the intake valve 28 as explained above, the socket member 90 moves downwardly along the longitudinal center axis of valve stem 32 and simultaneously moves radially inwardly towards the center of the cylinder. At the same time, the head end 60 of the finger follower 56 moves in a plane which is perpendicular to a plane passing through the rotational axes of the camshafts 50 and 52. The spherical joint composed of the socket member 90 and the half-ball 92 serves to compensate for this difference in transversal-angle plane between the inverted bucket tappet 84 and the finger follower 56. A more detailed explanation of this movement between the two can be obtained from my U.S. Pat. No. 5,645,023 issued on Jul. 8, 1997 and entitled "Valve Train For An Internal Combustion Engine."

Inasmuch as the valve train mechanism 15 is a mirror image of the valve train mechanism 14, it will be understood that rotation of the cam-lobe shaft 52 results in the same operation of the finger follower 58, the associated rollers 66–70, and movement of the exhaust valve 30 as described above in connection with the valve train mechanism 14 and therefore needs not to be repeated herein.

Figure 4:
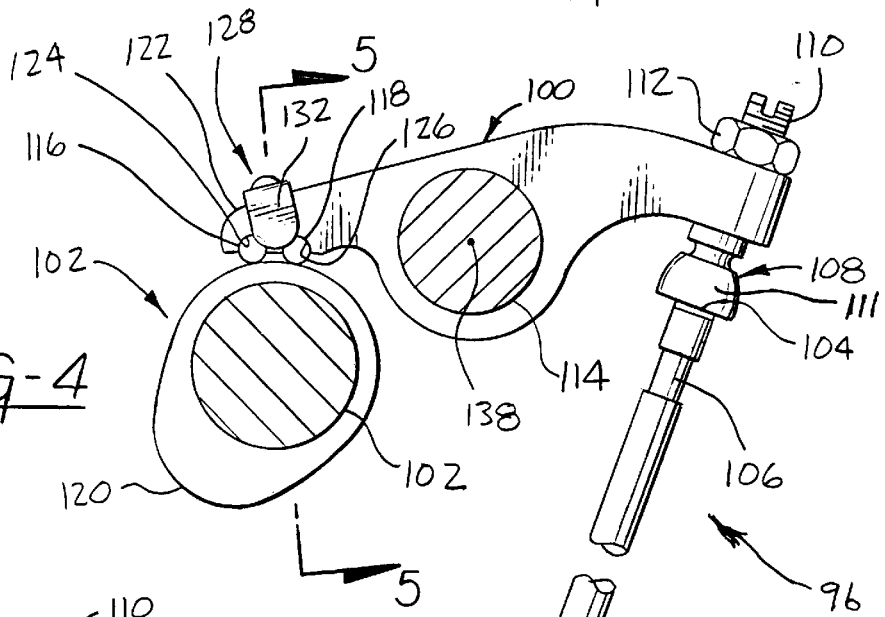
FIG. 4 is a view of an actuator in the form of a rocker arm employing a mini-roller assembly of the type seen in FIGS. 1 and 2.
Figure 5:
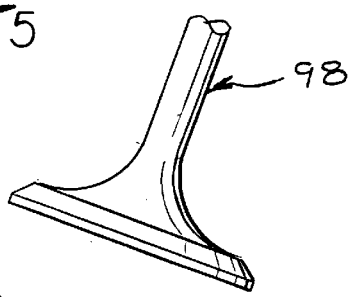
FIG. 5 is a sectional view taken on line 5—5 of FIG. 4.
Figure 5:
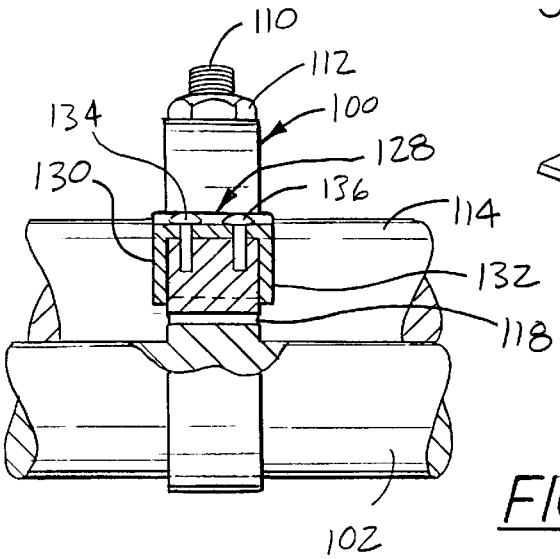

FIGS. 4 and 5 show a valve train mechanism 96 of an internal combustion engine that takes the form of a single overhead camshaft (SOHC) mechanism provided with a mini-roller arrangement according to the present invention that is similar to that described above except that the valves of the engine are to be moved to the open position by rocker arms rather than finger followers. In addition, although all the parts of an operating valve train mechanism are not shown in FIGS. 4 and 5, it will be understood that the valve 98 shown would be normally biased into a closed position relative to a port by a spring and that the rocker arm 100 and the camshaft 102 would be supported for rotation and pivotal movement, respectively, by the cylinder head of the engine. Also, the valve 98 can be an exhaust valve or an intake valve serving to open the port leading to a combustion chamber.

As seen in FIG. 4, the rocker arm 100 has a body portion one end of which contacts the upper end 104 of the valve stem 106 of the valve 98 through a mechanical lash adjuster 108 composed of an adjusting screw 110, an elephant foot 111 and a lock-nut 112. An intermediate part of the body portion of the rocker arm 100 is supported for pivotal movement by a shaft 114 while the other end of the body portion is provided with a pair of side-by-side identical shaftless mini-rollers 116 and 118 adapted to be contacted by a cam-lobe 120 of the camshaft 102. The rollers 116 and 118 are essentially the same in construction as the roller 66 and 70 and are located in a saddle portion 122 formed at one end of the rocker arm 100 along spaced axes which are parallel to the rotational axis of the rocker shaft 114. The saddle portion 122 includes a pair of partial cylindrical bearing surfaces 124 and 126 which serve to respectively encapsulate the rollers 116 and 118. The diameter of each bearing surfaces 124 and 126 is larger than the diameter of the associated roller to allow the formation of a hydrodynamic oil film. Also, the bearing surfaces 124 and 126 are on the bottom side of the saddle portion 122 and, accordingly, face downwardly rather then upwardly as in the case of the bearing surfaces 72–76 of the finger followers 56 and 58. Nonetheless, hydrodynamic lubrication can still be provided to the rollers with the oil being picked up from splash and oil vapors in the overhead. However, a more effective lubrication method could be provided in this case by having a depression or well (not shown) formed in the top side of the saddle portion 122 of the rocker arm 100 above the vertical center of the rollers 116 and 118 to collect oil and by having the well connected to each bearing surface by a small hole (not shown) . An arrangement of this type can be seen in the above-mentioned patent application. It will also be noted that, as in the case of the bearing surfaces 72–76, each bearing surface 124 and 126 has its circumference surrounding the associated roller by more than one half of its total circumference with sufficient roller being exposed for contact with the cam lobe 120. Accordingly, the rollers 116 and 118 are effectively encapsulated by their accommodating bearing surfaces and cannot drop out of the bearing surfaces.

In this embodiment of the invention as seen in FIGS. 4 and 5, the rollers 116 and 118 are prevented from excessive axial movement by a U-shaped clip 128, the center portion of which is disposed on top of the saddle portion 122 of the rocker arm 100. The clip 128 provides axial entrapment for the rollers 116 and 118 within their cavities or bearing surfaces 124 and 126 by the action of its two legs 130 and 132 straddling the opposed sides of the rocker arm 100 as seen in FIG. 5. The clip 128 is held in place by a pair of rivets 134 and 136 or other equivalent fastening means anchored to the rocker arm 100. This assembly also reduces the bulk and mass of the elements at the end of the saddle portion 122 of the rocker arm 100 so as to lower the dynamic loads, spring-force requirements, friction, fuel consumption and emissions of the engine while allowing higher terminal speed for the valve train 96.

Figure 2:
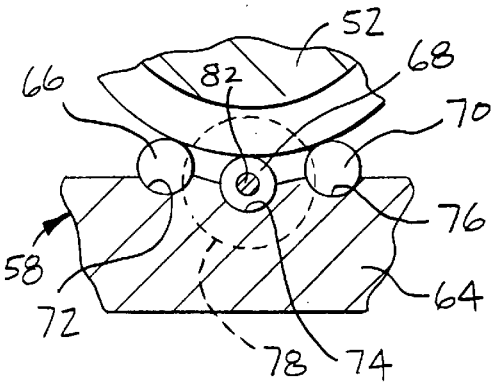
FIG. 2 is an enlarged view of the mini-roller assembly incorporated with the valve train mechanism operating the exhaust valve seen in FIG. 1.

As best seen in FIGS. 1 and 4, special cam-lift curves will be required on the cam-lobes with this type of multiple-mini-roller mechanism when used with pivoted cam followers such as the finger followers 56 and 58 shown in FIGS. 1, 2 and 3 and the rocker arm arrangement of FIGS. 4 and 5. Such cam-lift curve may be needed because, as seen in FIG. 4, the engagement of the cam-lobe 120 with the roller 118 closest to the pivot point 138 will produce more valve lift than when the roller 116, which is further away from the pivot point, is engaged by the cam-lobe 120. Therefore, depending on the sense of rotation of the camshaft with respect to the mechanism, the raising and falling flanks of the lift curve will be different, and would have to be compensated for by using asymmetrical cam lobes to allow a smooth transition from the leading to the trailing roller. Otherwise, an instantaneous interruption of the lift curve will occur as the camshaft disengages from one roller to engage the other.

Figure 6:
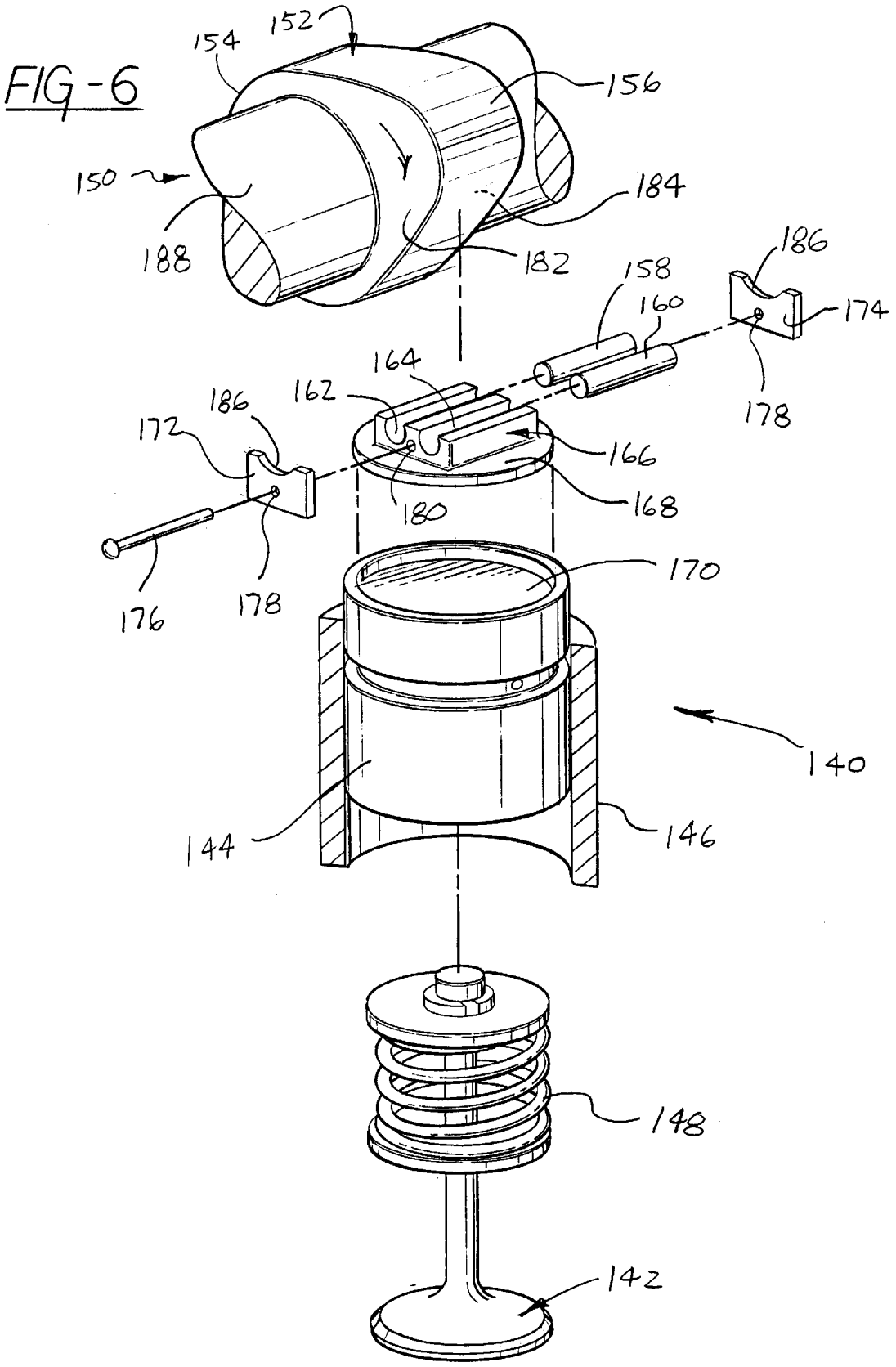
FIG. 6 is an exploded view in perspective of a direct-acting overhead camshaft mechanism that includes an inverted bucket tappet provided with a mini-roller assembly according to the present invention.

FIG. 6 is an isometric exploded view of some elements cut away and others in partial section for simplicity in showing a direct-acting camshaft mechanism or valve train mechanism 140 according to the present invention for operating a valve 142 (such as an exhaust valve or an intake valve) in each cylinder of an internal combustion engine.

The valve train mechanism 140 includes an inverted-bucket tappet 144 slidably disposed within a tappet guide 146 of the cylinder head structure (not shown) for driving the valve 142 to its open position against the biasing force of a valve-return spring 148. An overhead camshaft 150 rotationally disposed in bearing supports (not shown) located above the cylinder head (not shown), has a plurality of cam-lobes, only one of which is shown and identified by the reference numeral 152. As shown, the cam-lobe 152 consists of a base-circle portion 154 and a lift portion 156 and serves to operate one valve of the cylinder head of an engine. Located on the inverted-bucket tappet 144 are two identical shaftless mini-rollers 158 and 160 which are adapted to be respectively disposed in partial cylindrical cavities 162 and 164 formed in a saddle portion or bearing block 166 integral with a disk member 168 as its base. The disk member 168 is adapted to be located in a cylindrical cavity 170 formed in the top portion of the tappet 144 which, in this case, takes the form of a mechanical adjustment tappet. Alternatively, in the case of hydraulic tappets, the disk member 168 could be formed integrally with the top surface of the tappet 144. The cavities 162 and 164 serve as bearing surfaces for the rollers 158 and 160 and, as in the case of the bearing surfaces 124 and 126 provided in the valve train mechanism 96 described above; their active circumference is more than half their total circumference. Thus, the rollers 158 and 160 are radially encapsulated within the accommodating cavities, which can be machined as full bores and then have their excess material cut off at the point where the rollers 158 and 160 engage the cam-lobe 152.

In operation and as is the case with the valve train mechanisms of FIGS. 1–5, when the camshaft 150 is in the dwell period, both rollers 158 and 160 contact the lobe's base circle 154 simultaneously. At the start of lift, and with the camshaft rotating in the clockwise direction as shown by the arrow in FIG. 6, only the leading roller 160 is in contact with the lift portion 156 of the cam-lobe 152. During the following lift portion, both rollers 158 and 160 are in contact (if a "blunt-nose" cam lobe, or one with a constant-lift period is used); and in the closing phase of the cam-lobe 152, only the trailing roller 158 contacts the cam-lobe 152. Also, as with the valve train mechanisms 14, 15 and 96 described above, the circular encapsulation of the rollers 158 and 160 by the accommodating cavities 162 and 164 retains the non-contacting roller in position within the bearing surface during the period when it is not in contact with the cam-lobe 152. In this case, the opposed ends of the rollers 158 and 160 are adapted to be restricted from axial movement by two end-plates 172 and 174 held in place at each side of the bearing block 166 by a long rivet 176 which is adapted to extend through a hole 178 formed in the lower portion of each end plate 172 and 174 and pass through a hole 180 formed at a center-point between both bearing surfaces 162 and 164 and parallel to them, on the lower portion of the bearing block 166. The upper-portion of each of the end-plates 172 and 172 is at a point higher than the rollers 158 and 160 located in the accommodating cavities so that it can straddle the sides 182 and 184 of the cam-lobe 152. This then provides the self-alignment function which allows the rollers 158 and 160 to always rotate in parallel to the surface of the cam-lobe 152. Thus, the upper portion of each of the end-plates 172 and 174 is undercut, as shown by reference numeral 186, with a sector of an arc, the radius of which is larger than that of the shaft portion 188 of the camshaft 150 so that both end-plates 172 and 174 can engage the cam-lobe 152 without touching the shaft portion 188. The internal diameter of each of the cavities 162 and 164 is always larger than the external diameter of the associated rollers to allow an oil film to form thereinbetween in accordance with hydrodynamic lubrication principles. The oil for this purpose is supplied by the abundant oil splash found on overhead-camshaft mechanisms as excess from the lubrication of the camshaft journals. As with the valve train mechanisms 14, 15, and 96, the two mini-rollers 158 and 160 used in this mechanism will be lighter than a single free-roller element provided in the valve train mechanisms described in my aforementioned U.S. patent application. The bearing block 166 supporting the rollers 158 and 160 will also be lighter, therefore providing a valve train mechanism with lower mass overall. Also, the combination of thin rollers and low-height bearing block provides a valve train mechanism with lower profile than if a conventional single-roller were to be used.

Figures 7, 8:
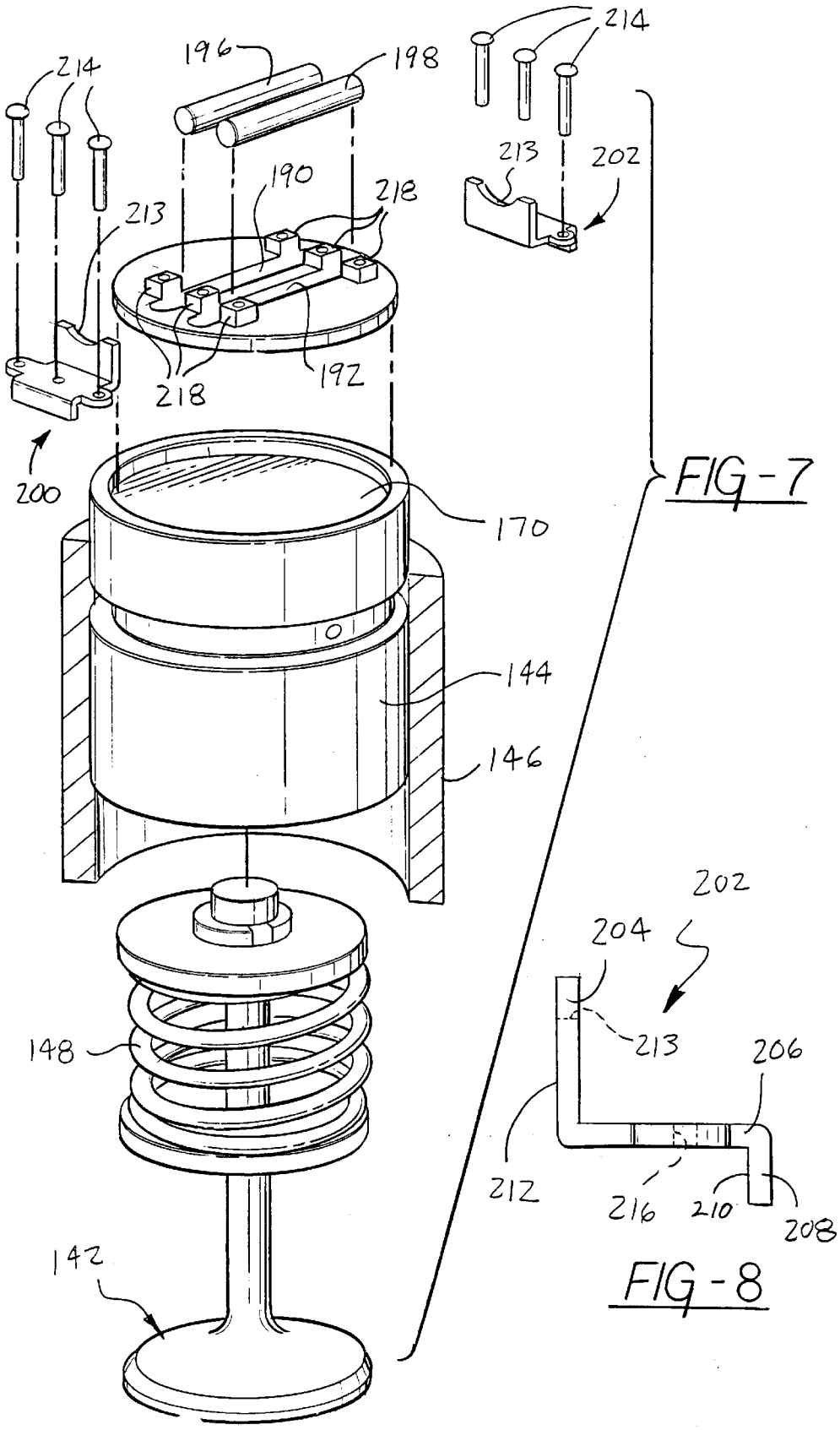
FIG. 7 is a perspective view of a modified mini-roller assembly for a direct-acting overhead camshaft mechanism of the type seen in FIG. 6.
FIG. 8 is an enlarged side view of one of the end plates incorporated in the modified mini-roller assembly seen in FIG. 7.

FIGS. 7 and 8 show a modified form of the disk member 168 employed with the valve train mechanism 140 of FIG. 6. With the arrangement shown in FIGS. 7 and 8, it is possible to obtain a mechanism with a lower height than that provided by the valve train mechanism 140. In this case, the cavities or bearing surfaces 190 and 192 are recessed in the top surface of the disk member 194 with half or less of their true circumference formed in the body of the disk member 194. By so doing, the top of the mini-rollers 196 and 198 (when located in the bearing surfaces 190 and 192) as well as the level of the camshaft will be lowered 2 to 3 mm below that of the valve mechanism 140. The bearing surfaces 190 and 192 can be machined by milling, and finished by grinding. As seen in FIG. 7, the rollers 196 and 198 in this case are made longer than the rollers 158 and 160 so as to allow vertical encapsulation by a pair of identical "Z" shaped end-pieces 200 and 202. As seen in FIG. 8, each of the end pieces 200 and 202 comprises a vertical upper leg 204, a horizontal body section 206, and a vertical lower leg 208 and has three functions. First, the inner surface 210 of the leg 208 provides axial encapsulation of the rollers 196 and 198 within the bearing surfaces 190 and 192. Second, its horizontal body section 206 provides the vertical encapsulation for the rollers 196 and 198 by retaining them in place on their extra length. The third function of each end piece 200 and 202 is to use the vertical surface 212 of and the arcuate cut-out 213 in leg 204 to provide the guidance for the mechanism by engaging the opposed sides of the associated cam-lobe. A plurality of rivets 214 are adapted to secure each of the end-pieces 200 and 202 to the disk member 194 through holes 216 formed in the center portion of the horizontal body section 206. Stanchions 218 have holes drilled therein that are adapted to register with holes 216 in the body section 206 to provide the anchoring point for the rivets 214. The stanchions 218 are of a height so as to prevent the horizontal body section 206 of the end-pieces 200 and 202 from locking the rollers 196 and 198 tightly in place and preventing their rotation. Alternatively, in lieu of the stanchions 218 formed integrally with the disk member 194, one could substitute spacers, either as loose pieces or integrally-formed with the underside of the horizontal body section 206.

Compared with conventional mechanisms using shafted rollers, it should be apparent that the mass and inertia of the valve train mechanisms described above can be substantially lower, so as to improve the valve-train dynamic characteristics, or increase the engine speed, or reduce the friction; always in the interest of increased power with lower fuel consumption and emissions. Also, with the smaller-diameter mini-rollers, the total height of the mechanisms can be much lower than if they used only a single roller.

Various changes and modifications can be made to the above described valve train mechanism without departing from the spirit of the invention. Such changes are contemplated by the inventor and he does not wish to be limited except by the scope of the appended claims.

The embodiments of the invention in which an exclusive property or privilege is claimed are defined as follows:

1. In a valve train mechanism of an internal combustion engine having a cylinder head, a camshaft having cam-lobe and being supported for rotation in said engine, a valve mounted in said cylinder head for movement between an open position and a closed position, said valve being provided with a spring for biasing said valve into said closed position, an actuator located between said camshaft and said valve, said cam-lobe of said camshaft cooperating with said actuator to apply a lifting force to move said valve to said open position against the bias of said spring during rotation of said camshaft, the improvement wherein said actuator is provided with at least a pair of concave bearing surfaces each of which is provided with a shaftless roller, the arrangement being such that said cam-lobe of said camshaft initially contacts one of said rollers after which said cam-lobe contacts the next adjacent roller during rotation of said camshaft so as to transmit said lifting force from said camshaft to said valve.

2. The valve train mechanism of claim 1 wherein means are connected to said actuator for preventing said shaftless rollers from moving axially relative to said concave bearing surface.

3. The valve train mechanism of claim 1 wherein each of said concave bearing surfaces is greater than one half of the circumference of the associated roller.

4. The valve train mechanism of claim 1 wherein guide means are operatively associated with said rollers and engage the opposed sides of the cam-lobe for preventing said rollers from losing contact with said cam-lobe.

5. In a valve train mechanism of an internal combustion engine having a cylinder head, a camshaft supported for rotation in said engine, a valve mounted in said cylinder head for movement between an open position and a closed position, said valve having a valve stem and being provided with a spring for biasing said valve into said closed position, a rocker arm located between said camshaft and said valve, said rocker arm having the intermediate portion thereof supported by said cylinder head for pivotal movement and having one end engaging the upper end of said valve stem, the other end of said rocker arm being provided with at least a pair of side-by-side cavities each of which takes the form of a concave bearing surface, a shaftless roller located in each of said cavities, said camshaft having a cam-lobe for initially engaging only one of the rollers and subsequently engaging the next adjacent roller so as to provide a valve lifting force to rollers to cause said rocker arm to pivot and act through said one end of said rocker arm to move said valve to said open position against the bias of said spring.

6. The valve train mechanism of claim 5 wherein said cavities are located in the lower surface of said one end of said rocker arm and each has a circumference greater than one-half the diameter of the associated roller.

7. The valve train mechanism of claim 5 wherein means are connected to said one end of said rocker arm to prevent said roller in each of said cavities from moving axially relative to the associated cavity.

8. The valve train mechanism of claim 7 wherein said means takes the form of a clip attached to said rocker arm and provided with a pair of depending members for prevent axial movement of each of the rollers.

9. In a valve train mechanism of an internal combustion engine having a cylinder head, a camshaft supported for rotation in said engine, a valve mounted in said cylinder head for movement between an open position and a closed position, said valve being provided with a spring for biasing said valve into said closed position, a finger follower located between said camshaft and said valve, said finger follower having one end thereof supported by said cylinder head for pivotal movement and having the other end actuating said valve, at least a pair of cavities formed in said finger follower intermediate said one end and said other end, a shaftless roller located in each of said cavities for rotation relative thereto, said camshaft having a cam-lobe initially engaging said one of said shaftless rollers and subsequently engaging the next adjacent shaftless roller so as to provide a valve lifting force to said finger follower to cause the latter to pivot and act through said other end of said finger follower to move said valve to said open position against the bias of said spring.

10. The valve train mechanism of claim 9 wherein said cavities are formed in the upper surface of said finger follower.

11. In a valve train mechanism of an internal combustion engine having a cylinder head, a camshaft having cam-lobe and being supported for rotation in said engine, a valve mounted in said cylinder head for movement between an open position and a closed position, said valve being provided with a spring for biasing said valve into said closed position, an inverted bucket tappet having its top surface provided with a disk member and being located between said camshaft and said valve, said cam-lobe of said camshaft cooperating with said disk member to apply a lifting force to move said valve to said open position against the bias of said spring during rotation of said camshaft, the improvement wherein said disk member is provided with at least a pair of concave bearing surfaces each of which is provided with a shaftless mini-roller, the arrangement being such that said cam-lobe of said camshaft initially contacts one of said mini-rollers after which said cam-lobe contacts the next adjacent mini-roller during rotation of said camshaft so as to transmit said lifting force from said camshaft to said valve.

12. The valve train mechanism of claim 11 wherein said bearing surfaces are formed in a bearing block which is integrally formed with the top surface of said inverted bucket tappet.

13. The valve train mechanism of claim 11 wherein said bearing surfaces are recessed into the top surface of said inverted bucket tappet.

14. The valve train mechanism of claim 12 wherein a pair of end plates are secured to said bearing block for preventing axial movement of said mini-roller relative to the accommodating bearing surface.

15. The valve train mechanism of claim 13 wherein a pair of end-pieces are secured to said disk member and serve to prevent axial movement and vertical movement of said mini-roller relative to the accommodating bearing surface and wherein said end-pieces have upstanding legs cooperating with the opposed sides of said cam-lobe to provide guidance for the mechanism.

* * * * *